US006734751B2

(12) United States Patent
Kawanami et al.

(10) Patent No.: US 6,734,751 B2
(45) Date of Patent: May 11, 2004

(54) CENTER ELECTRODE ASSEMBLY, MANUFACTURING METHOD THEREFOR, NONRECIPROCAL CIRCUIT DEVICE, AND COMMUNICATION APPARATUS

(75) Inventors: Takashi Kawanami, Ishikawa-ken (JP); Keiji Okamura, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 45 days.

(21) Appl. No.: 10/140,188

(22) Filed: May 8, 2002

(65) Prior Publication Data

US 2002/0180550 A1 Dec. 5, 2002

(30) Foreign Application Priority Data

Jun. 5, 2001 (JP) ..... 2001-170016

(51) Int. Cl.[7] ..... H01P 1/32; H01P 1/36
(52) U.S. Cl. ..... 333/1.1; 333/24.2
(58) Field of Search ..... 333/1.1, 24.2

(56) References Cited

U.S. PATENT DOCUMENTS 5,180,997 A * 1/1993 Stern et al. ..... 333/24.2
5,223,805 A * 6/1993 Talcott et al. ..... 333/1.1
5,620,543 A * 4/1997 Marusawa et al. ..... 156/89.12
5,994,974 A * 11/1999 Makino et al. ..... 333/24.2
6,462,628 B2 * 10/2002 Kondo et al. ..... 333/24.2
6,512,424 B2 * 1/2003 Furuya et al. ..... 333/1.1

FOREIGN PATENT DOCUMENTS

JP 2001-60808 3/2001

* cited by examiner

*Primary Examiner*—Michael Tokar
*Assistant Examiner*—Linh Van Nguyen
(74) *Attorney, Agent, or Firm*—Keating & Bennett, LLP

(57) ABSTRACT

A center electrode assembly installed in a lumped-constant isolator includes a ferrite member having a substantially rectangular shape and three central conductors. Each of the central conductors includes a grounded leg portion which extends upward from a ground plate provided at the bottom surface of the ferrite along a side surface of the ferrite, which is bent at an upper ridge portion of the ferrite, and which extends on the top surface of the ferrite. The grounded leg portion of each of the central conductors is bent such that the grounded leg portion is substantially perpendicular to the upper ridge portion of the ferrite, and angular points of the central conductors, the angular points determining the crossing angle of the central conductors, are positioned on the top surface of the ferrite.

16 Claims, 16 Drawing Sheets

CENTER ELECTRODE ASSEMBLY, MANUFACTURING METHOD THEREFOR, NONRECIPROCAL CIRCUIT DEVICE, AND COMMUNICATION APPARATUS

BACKGROUND OF THE INVENTION

1. Field of the Invention

The present invention relates to a center electrode assembly included in, for example, an isolator, a circulator, or other suitable device, used in a microwave band, and to a manufacturing method for the center electrode assembly. In addition, the present invention also relates to a nonreciprocal circuit device and a communication apparatus including the nonreciprocal circuit device.

2. Description of the Related Art

An example of a known center electrode assembly used in lumped-constant isolators (nonreciprocal circuit devices) installed in mobile communication apparatuses such as mobile phones, is shown in FIG. 16A. With reference to FIG. 16A, a center electrode assembly 200 includes a microwave ferrite member 201 having a rectangular shape and three central conductors 202, 203, and 204 which cross each other at a predetermined angle on the top surface 201*c* of the ferrite member 201.

Each of the central conductors 202, 203, and 204 includes grounded leg portions which extend upward from a ground plate provided at the bottom surface of the ferrite member 201. Although only the grounded leg portions 202*a* of the central conductor 202 can be seen in the figure, the other central conductors 203 and 204 are also provided with grounded leg portions. The grounded leg portions 202*a* extend along a side surface 201*a* of the ferrite member 201, are bent at an upper ridge portion 201*b*, and extend over the top surface 201*c*.

In center electrode assemblies used in lumped-constant nonreciprocal circuit devices, the three central conductors are arranged such that the central conductors cross each other at an angle of 120° in a rotationally symmetrical manner. This is the condition for reliably making the electrical characteristics of input/output ports, to which the central conductors are connected, stable and symmetrical to each other. In addition, the central conductors are arranged such that the central conductors cross each other at angles shifted from 120° when specific electrical characteristics such as insertion loss characteristics and isolation characteristics are desired. In either case, the crossing angle of the central conductors is strongly related to the electrical characteristics so that the crossing angle significantly influences the electrical characteristics. Accordingly, it is extremely important to precisely position the central conductors at a desired crossing angle.

The size of nonreciprocal circuit devices can be effectively reduced by using a ferrite member having a rectangular shape. In such a case, the grounded leg portions of the central conductors are bent at the upper ridge portion of the ferrite member. In order to reliably position the central conductors at the desired crossing angle, it has been suggested to dispose angular points (see 202*b* in FIGS. 16A and 16B), at which the crossing angle between the central conductors is determined, on the upper ridge portion 201*b* of the ferrite member 201 in Japanese Unexamined Patent Application Publication No. 2001-60808.

However, due to the differences in thickness and width between each ferrite member, differences between jigs used for bending the central conductors, adjustment errors, etc., the angular points 202*b* are often displaced from the upper ridge portion 201*b* and are positioned on the side surface 201*a* or on the top surface 201*c*. Especially when the angular points 202*b* are on the side surface 201*a* as shown in FIG. 16B, a problem occurs in a process of bending the grounded leg portions 202*a* at the upper ridge portion 201*b*. That is, as shown in FIG. 18, when the grounded leg portion 202*a* is pushed in a direction shown by the arrow A, a bending point 202*c* is easily displaced to a point 202*c*'. When such a displacement occurs, as shown in FIG. 17, the central conductors 202, 203, and 204 are displaced from designed positions shown by the dashed lines to positions shown by the solid lines, so that the crossing angle therebetween is also changed from the designed value. Accordingly, desired electrical characteristics cannot be obtained.

SUMMARY OF THE INVENTION

In order to overcome the problems described above, preferred embodiments of the present invention provide a center electrode assembly in which the central conductors are reliably disposed at the desired crossing angle and with which desired electrical characteristics can be obtained. In addition, preferred embodiments of the present invention also provide a manufacturing method for the center electrode assembly, a nonreciprocal circuit device, and a communication apparatus.

According to a preferred embodiment of the present invention, a center electrode assembly includes a ferrite member having a substantially rectangular shape and a plurality of central conductors, each of the central conductors including a grounded leg portion which extends upward from a ground plate provided at the bottom surface of the ferrite member along a side surface of the ferrite member, which is bent at an upper ridge portion of the ferrite member, and which extends on the top surface of the ferrite member. The grounded leg portion of each of the central conductors is bent such that the grounded leg portion is substantially perpendicular to the upper ridge portion of the ferrite member, and angular points of the central conductors, the angular points determining the crossing angle of the central conductors, are positioned on the top surface of the ferrite member.

In the center electrode assembly according to preferred embodiments of the present invention, the angular points of the central conductors, the angular points determining the crossing angle of the central conductors, are reliably positioned on the top surface of the ferrite member. In addition, the grounded leg portion of each of the central conductors is bent at the upper ridge portion of the ferrite member such that the grounded leg portion is substantially perpendicular to the upper ridge portion of the ferrite member. Accordingly, the bending point can be prevented from being displaced in the horizontal direction in a bending process, so that the central conductors can be bent at the desired bending angle and the angular points can be prevented from being deformed. As a result, the central conductors are reliably positioned such that they cross each other at the designed crossing angle.

In addition, a manufacturing method for a center electrode assembly according to another preferred embodiment of the present invention includes the steps of positioning the ground plate at the bottom surface of the ferrite member and press-fitting the central conductors inside a concave portion of a mold so that the grounded leg portions are bent and extend along the side surfaces of the ferrite member, and pushing and bending the grounded leg portions at the upper ridge portions of the ferrite member toward the top surface of the ferrite member.

According to the manufacturing method of a preferred embodiment of the present invention, the grounded leg portions of the central conductors are bent such that the grounded leg portions extend along the side surfaces of the ferrite member in a single process. In addition, the central conductors can be positioned on the top surface of the ferrite member at the predetermined crossing angle by merely pushing and bending, toward the top surface of the ferrite member, the central conductors extending upward.

In addition, a nonreciprocal circuit device and a communication apparatus according to other preferred embodiments of the present invention include the center electrode assembly having the above-described characteristics, so that stable electrical characteristics can be obtained.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
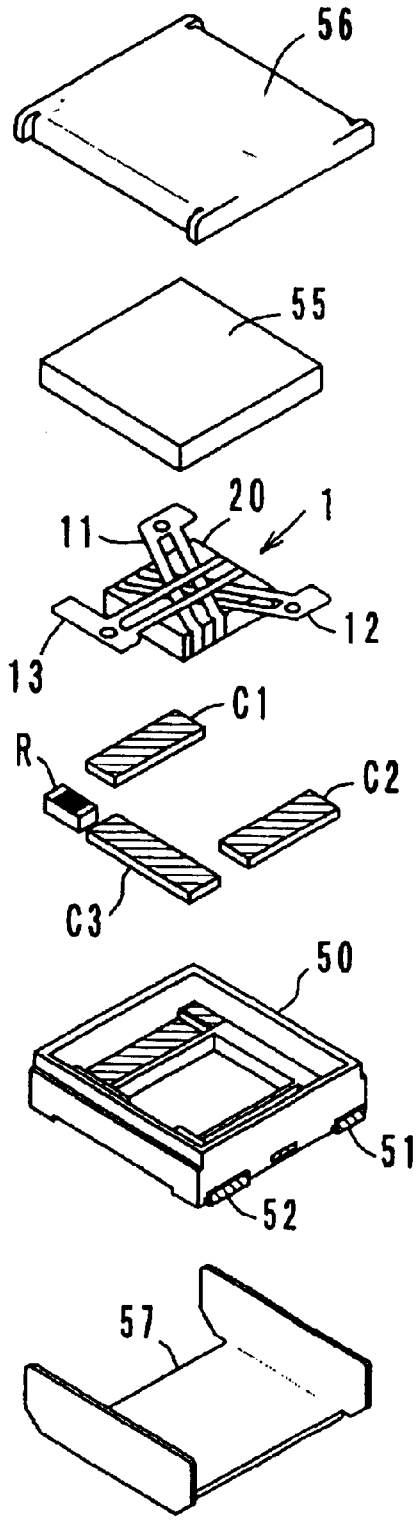
FIG. 1 is an exploded perspective view of a nonreciprocal circuit device including a center electrode assembly according to a first preferred embodiment of the present invention.

A center electrode assembly, a manufacturing method for the center electrode assembly, a nonreciprocal circuit device, and a communication apparatus according to preferred embodiments of the present invention will be described below with reference to the accompanying drawings. In the drawings corresponding to each preferred embodiment, similar components and elements are denoted by the same reference numerals and redundant explanations are omitted.

Figure 2:
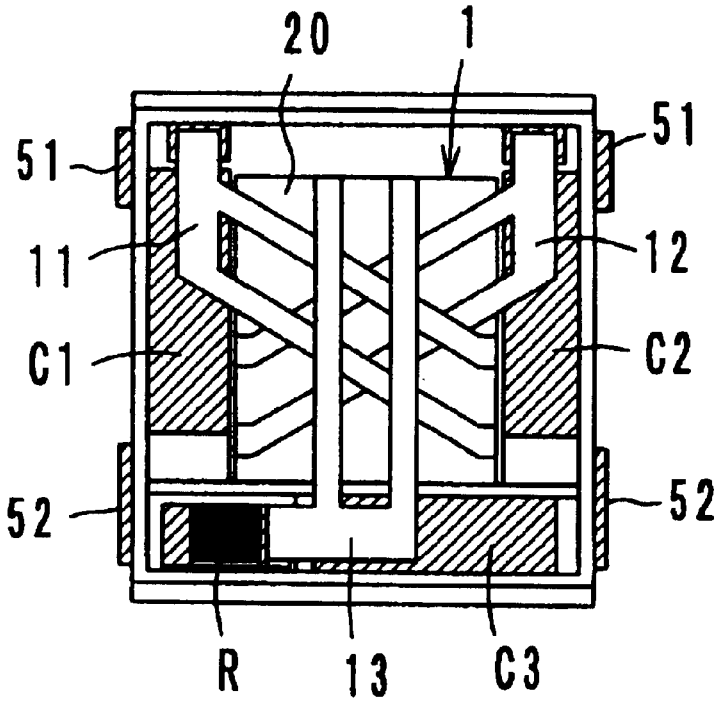
FIG. 2 is a plan view showing the internal structure of the nonreciprocal circuit device of FIG. 1.

FIG. 1 shows components of a nonreciprocal circuit device (lumped-constant isolator) including a center electrode assembly 1 according to a first preferred embodiment of the present invention. FIG. 2 shows a state in which the center electrode assembly 1 and peripheral components thereof are stored in a resin housing 50, and FIG. 3 shows an equivalent circuit of the nonreciprocal circuit device.

The nonreciprocal circuit device is constructed by arranging the center electrode assembly 1, which will be described below in detail, a permanent magnet 55, matching capacitors C1, C2, and C3, and a resistance R in a resin housing 50 and covering the resin housing 50 with metal cases (yokes) 56 and 57 from above and below.

Figure 3:
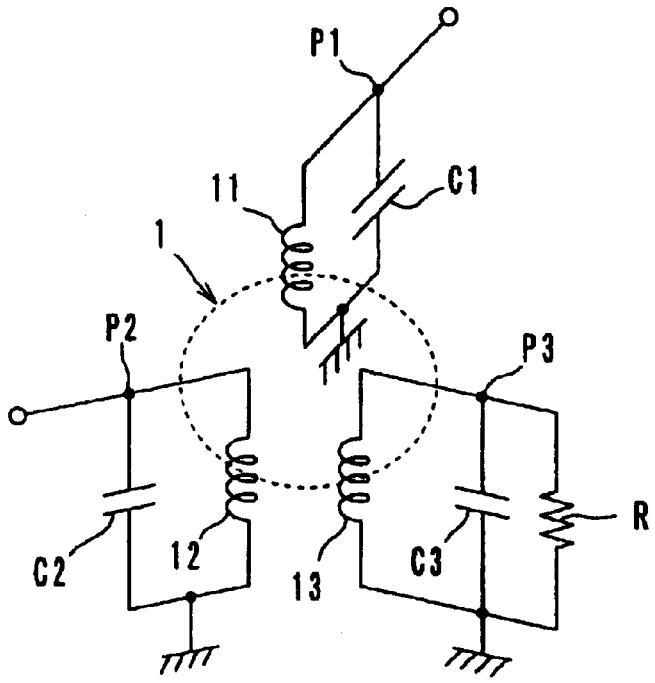
FIG. 3 is a circuit diagram of an electrical equivalent circuit of the nonreciprocal circuit device of FIG. 1.

The resin housing 50 is provided with an input/output terminal 51, a ground terminal 52, and conductors for connecting the matching capacitors C1, C2, and C3 and the resistance R, and such components are arranged inside the resin housing 50 in such a manner that a circuit equivalent to that shown in FIG. 3 is provided.

With reference to FIG. 3, the central conductors 11, 12, and 13 function as input/output ports P1, P2, and P3, respectively, at one end thereof, and are connected to the ground at the other end thereof. In addition, the matching capacitors C1, C2, and C3 are soldered to the input/output ports P1, P2, and P3, respectively, at 'hot' ends thereof, and are soldered to ground electrodes at 'cold' ends thereof.

One end of the resistance R is connected to the 'hot' end of the matching capacitor C3, and the other end is connected to the ground electrode. More specifically, the matching capacitor C3 and the resistance R are connected in parallel between the port P3 of the central conductor 13 and the ground electrode.

Now, the construction and bending process of the central conductors will be described with reference to FIGS. 4 to 8.

Figure 4:
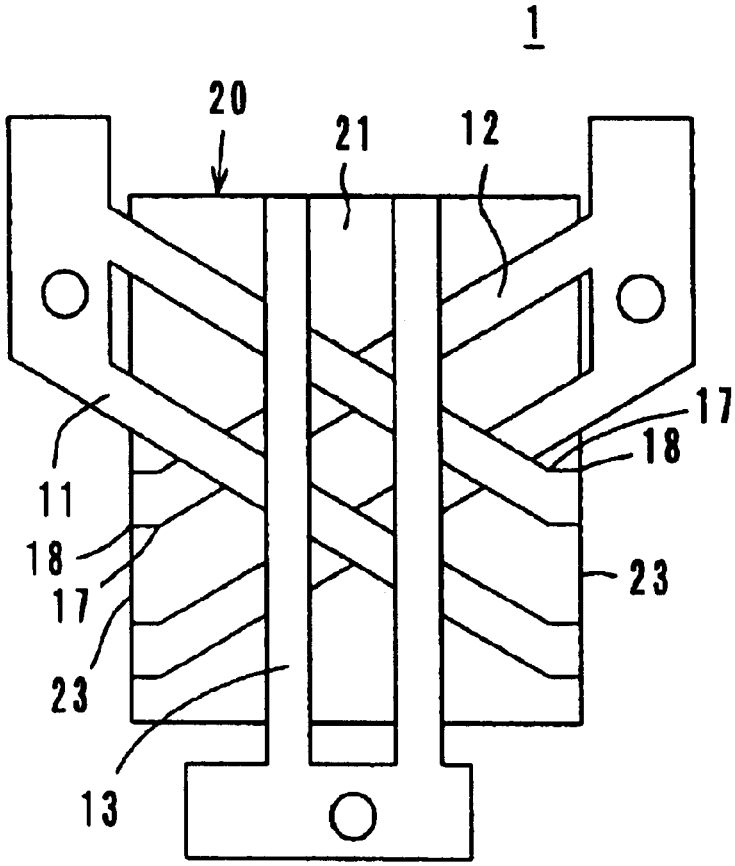
FIG. 4 is a plan view of the center electrode assembly according to the first preferred embodiment of the present invention.
Figure 5A:
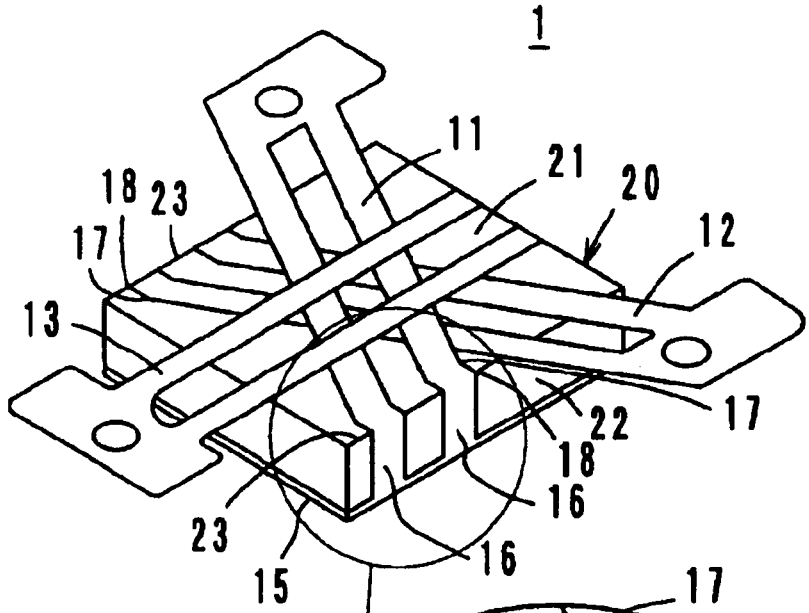
FIG. 5A is a perspective view of the center electrode assembly according to the first preferred embodiment.
Figure 5B:
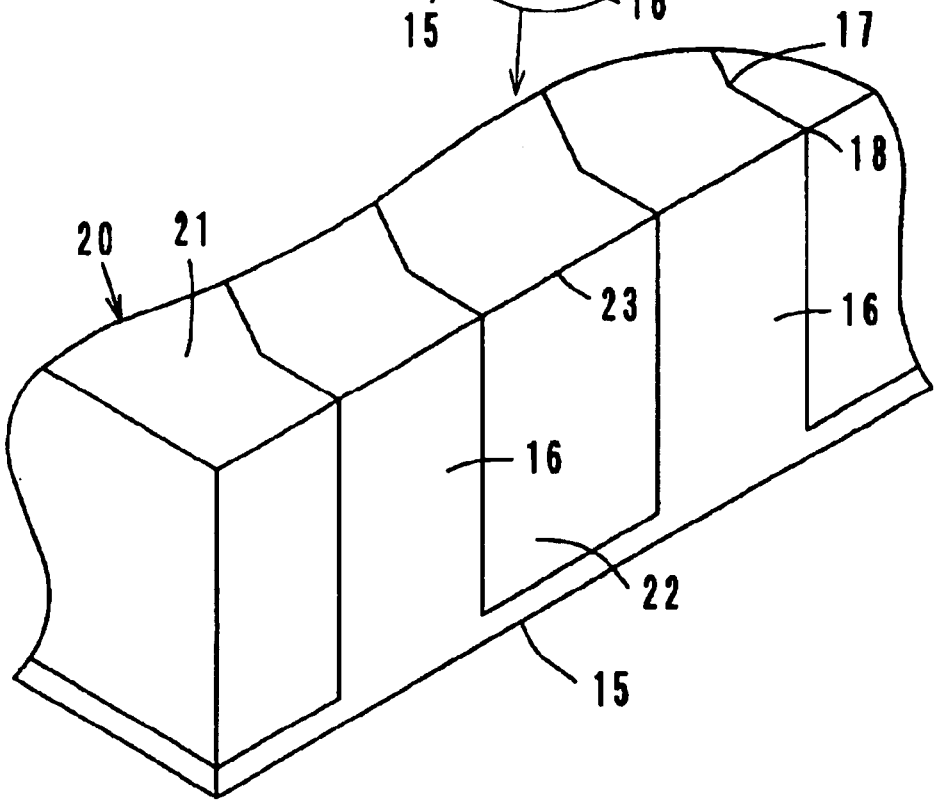
FIG. 5B is an enlarged view of the circled portion in FIG. 5A.

As shown in FIGS. 4, and 5A, the center electrode assembly 1 according to the first preferred embodiment includes a ferrite member 20 having a substantially rectangular shape and central conductors 11, 12, and 13, each of which is divided into two branch conductors. The central conductors 11, 12, and 13 cross each other at an angle of about 120° on the top surface 21 of the ferrite member 20.

Each of the central conductors 11, 12, and 13 includes grounded leg portions 16 which extend upward from a ground plate 15 provided at the bottom surface of the ferrite member 20. The grounded leg portions 16 extend along a side surface 22 of the ferrite member 20, are bent at an upper ridge portion 23 (see bending points 18), and extend over the top surface 21 of the ferrite member 20.

The grounded leg portions 16 of the central conductors 11, 12, and 13 are bent at the upper ridge portions 23 in such a manner that the central conductors 11, 12, and 13 are substantially perpendicular to the upper ridge portions 23, and angular points 17, at which the crossing angle is determined, are positioned on the top surface 21 of the ferrite member 20.

Figure 6A:
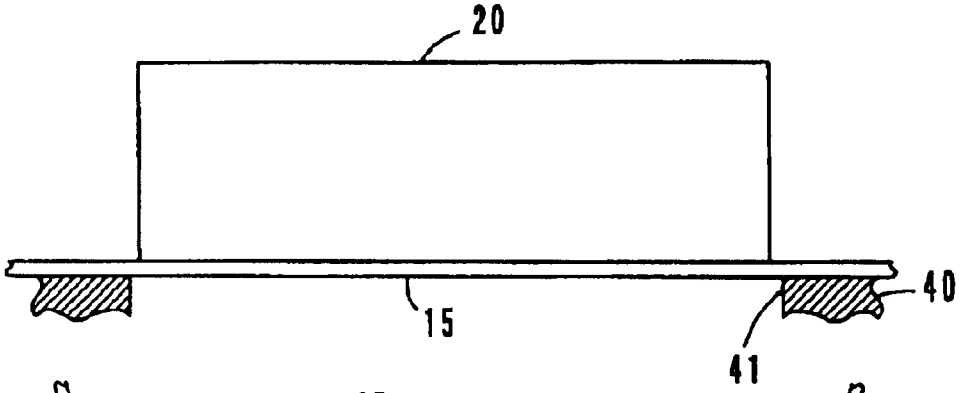
FIGS. 6A to 6C are diagrams showing processes for manufacturing the center electrode assembly according to the first preferred embodiment of the present invention.
Figure 6B:
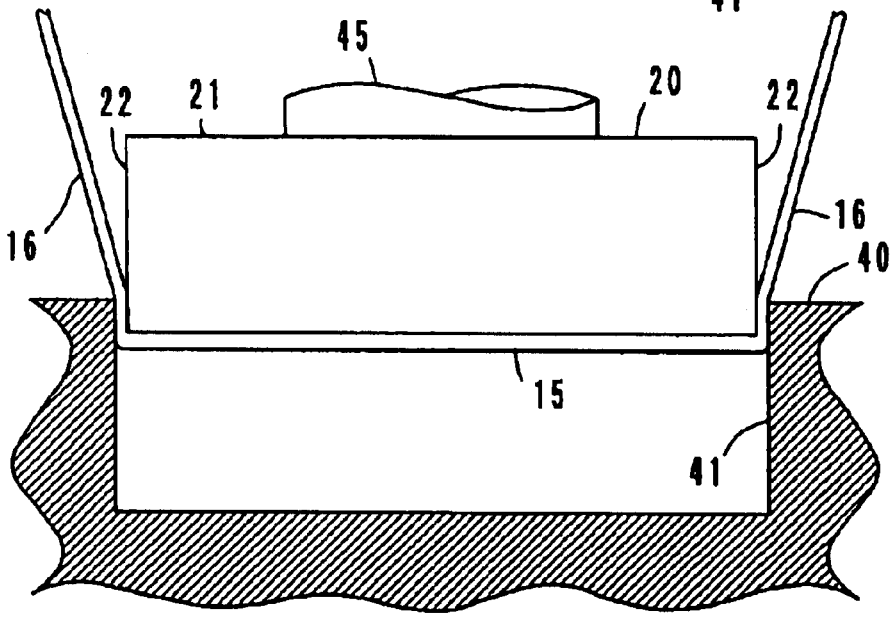
Figure 6C:
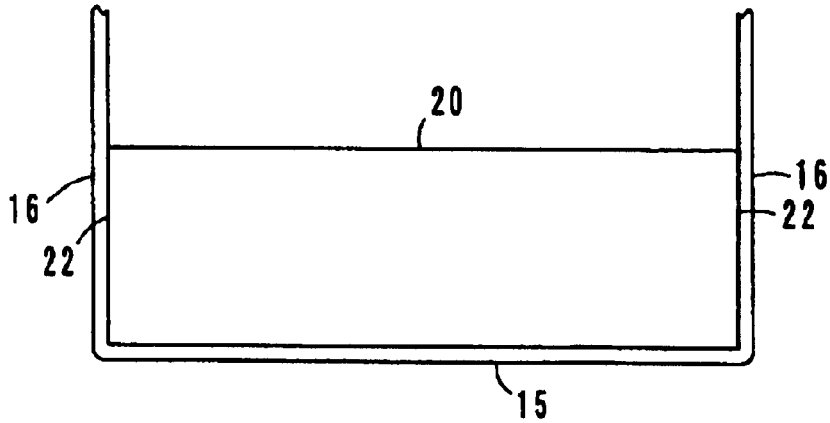

A bending process of the central conductors that are constructed as described above will be described below. First, as shown in FIG. 6A, the ground plate 15 is placed on the bottom surface of the ferrite member 20, and the ground plate 15 and the ferrite member 20 are disposed above a concave portion 41 of a mold 40. Next, as shown in FIG. 6B, the top surface 21 of the ferrite member 20 is pushed by a pusher 45, so that the central conductors and the ferrite member 20 are press-fitted into the concave portion 41. Accordingly, the grounded leg portions 16 of the central conductors are bent along the side surfaces 22 of the ferrite member 20 (see FIG. 6C).

Figure 7A:
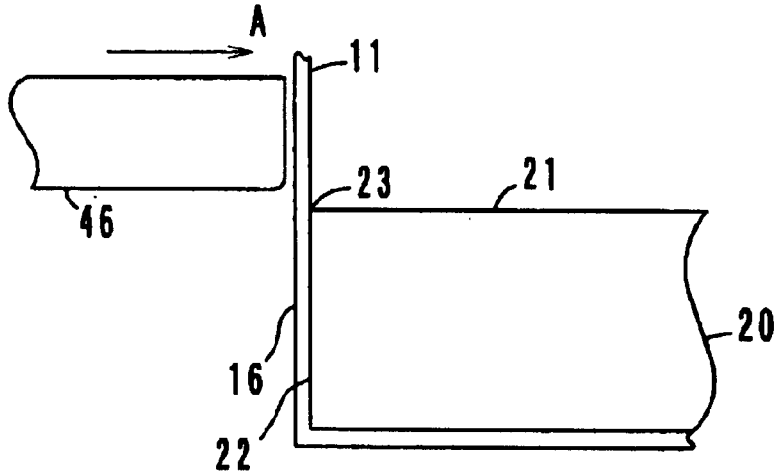
FIGS. 7A to 7C are diagrams showing processes for manufacturing the center electrode assembly according to the first preferred embodiment of the present invention.
Figure 7B:
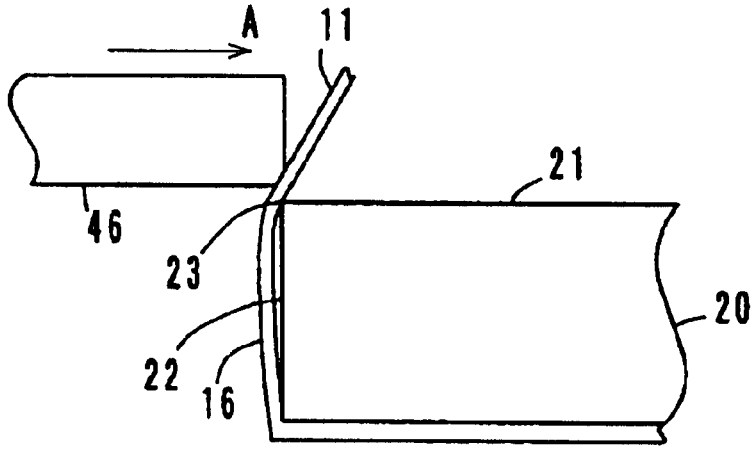
Figure 7C:
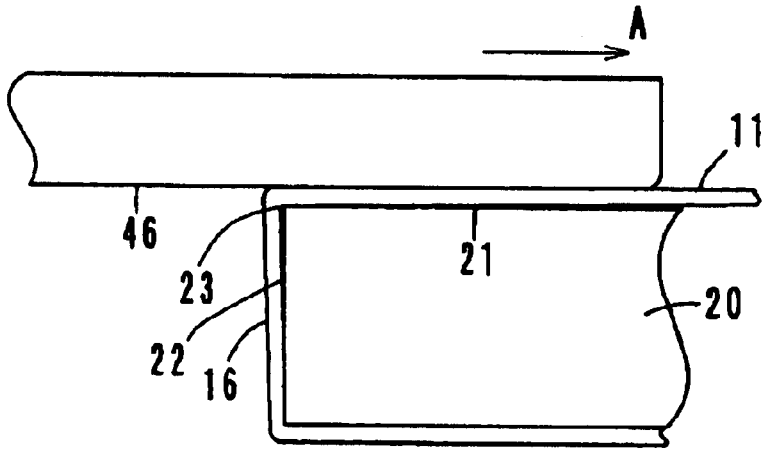

Next, as shown in FIGS. 7A, 7B, and 7C, a jig 46 is moved in the direction shown by the arrow A, and the central conductor 11 is pushed and bent toward the top surface 21 of the ferrite member 20 (the central conductors 12 and 13 are similarly pushed and bent). Accordingly, the grounded leg portion 16 is bent at the upper ridge portion 23 of the ferrite member 20, and the central conductor 11 is placed on the top surface 21 of the ferrite member 20 at a predetermined crossing angle.

Figure 8:
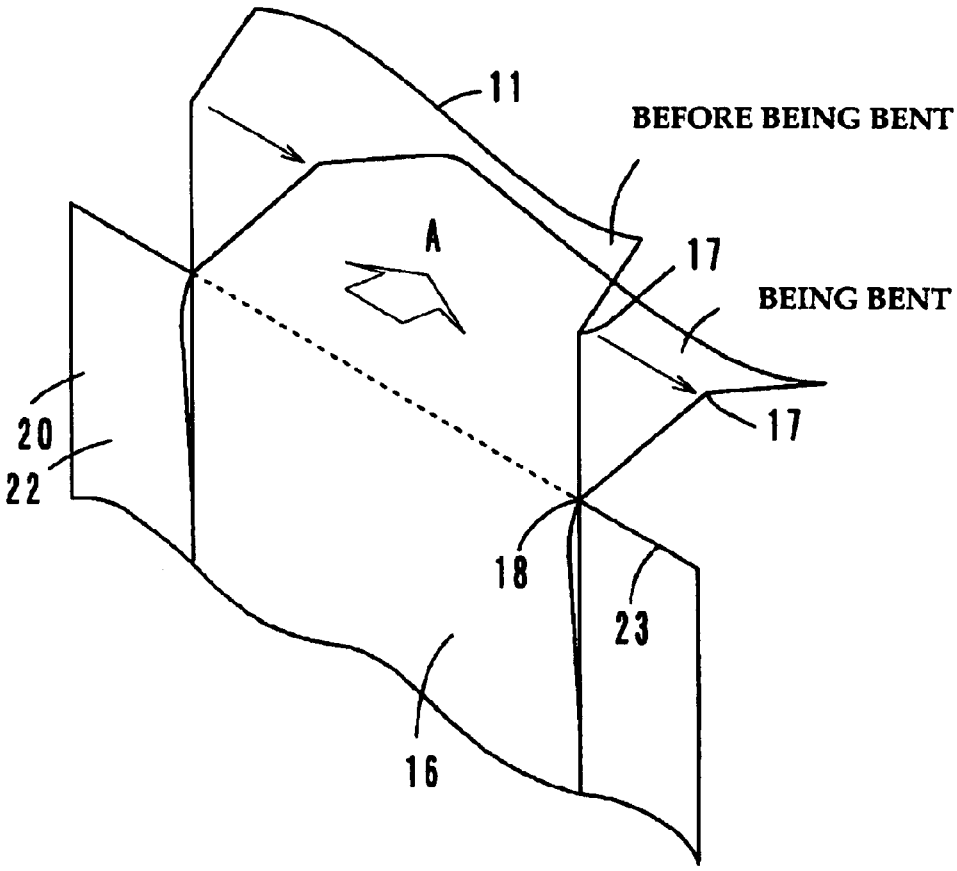
FIG. 8 is a perspective view showing a manner in which a central conductor is bent.
Figure 9:
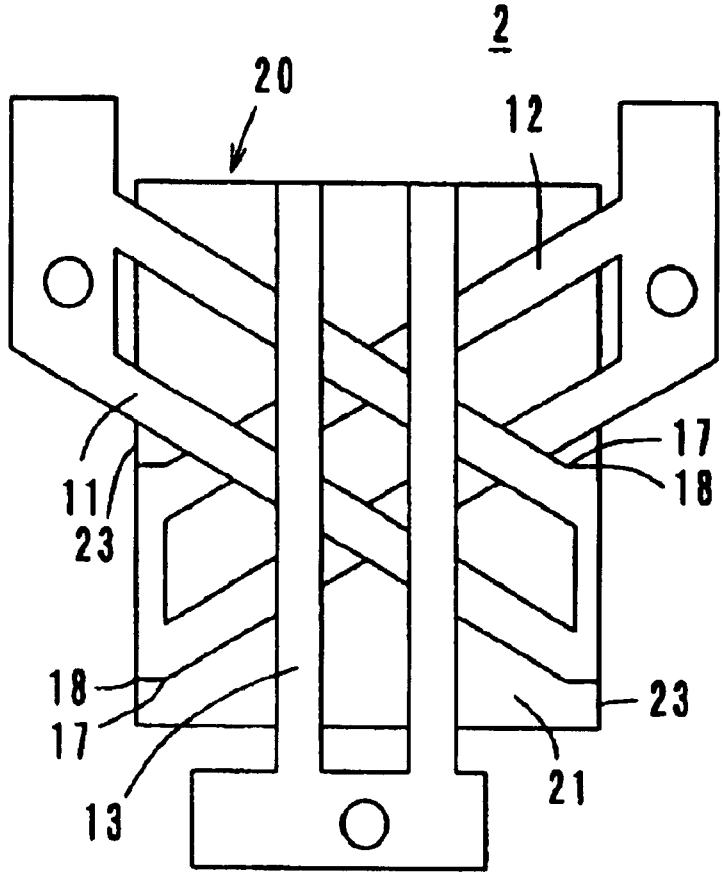
FIG. 9 is a plan view showing a center electrode assembly according to a second preferred embodiment of the present invention.
Figure 10A:
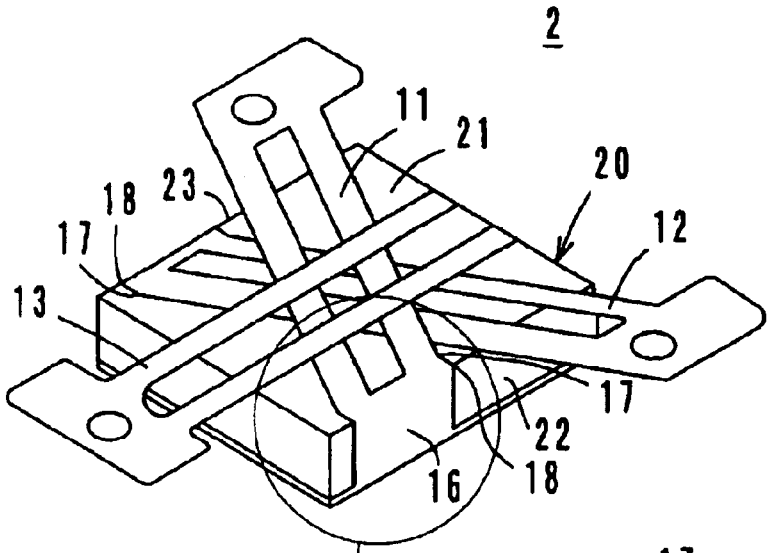
FIG. 10A is a perspective view of the center electrode assembly according to the second preferred embodiment.
Figure 10B:
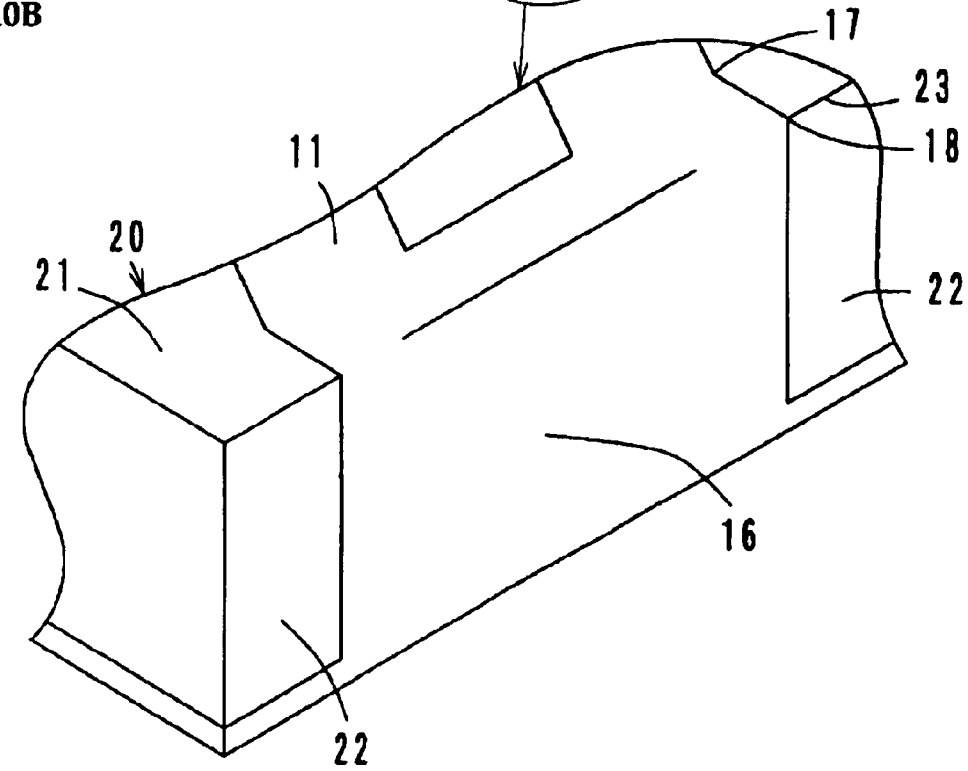
FIG. 10B is an enlarged view of the circled portion in FIG. 10A.
Figure 11:
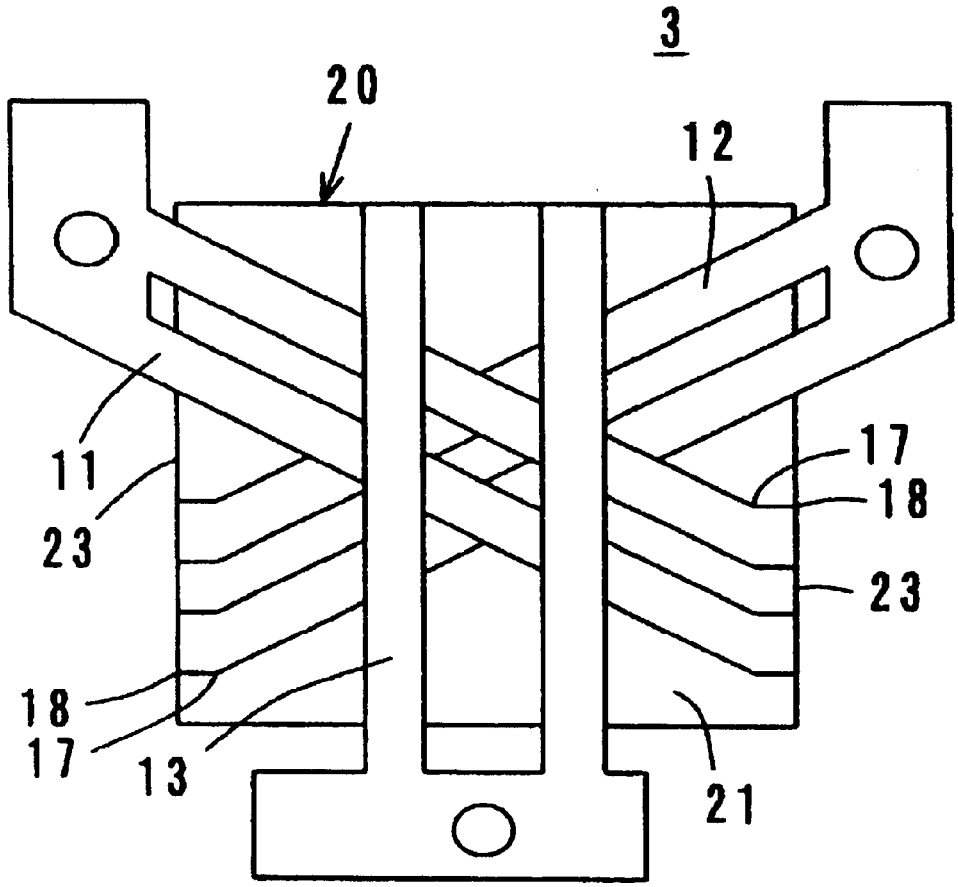
FIG. 11 is a plan view showing a center electrode assembly according to a third preferred embodiment of the present invention.
Figure 12:
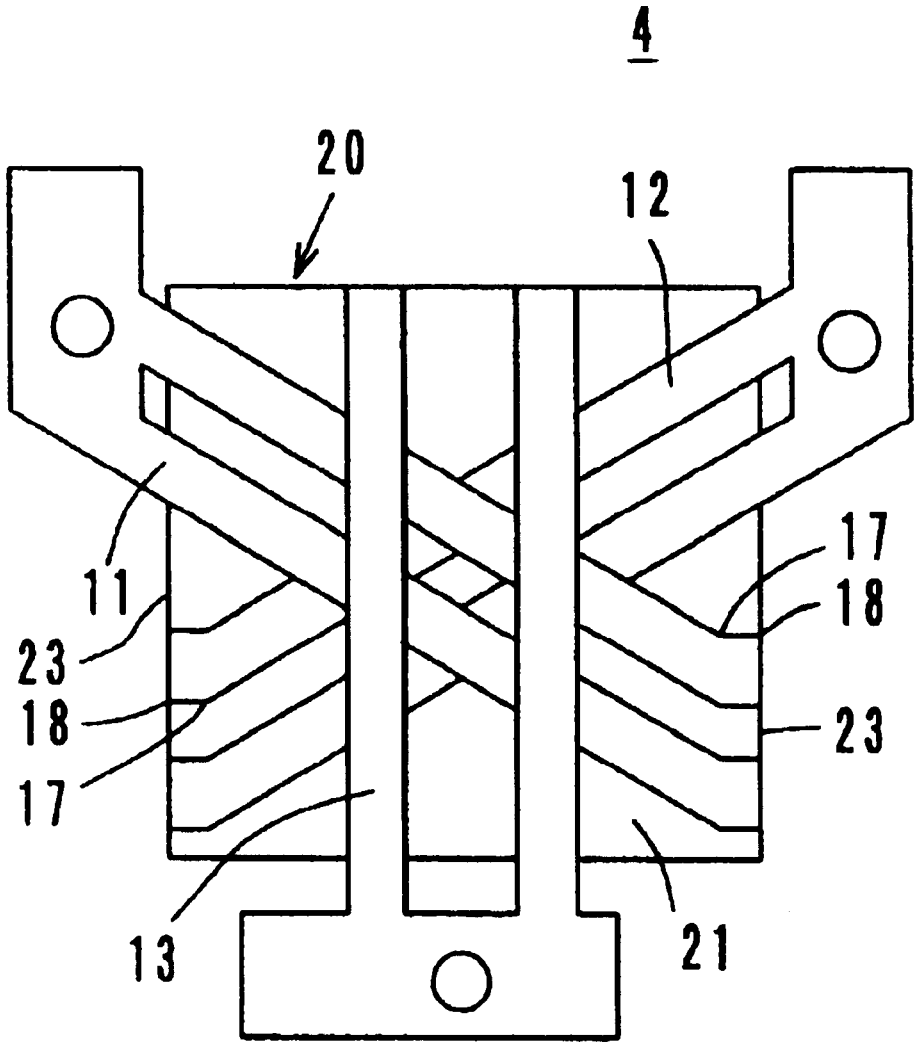
FIG. 12 is a plan view showing a center electrode assembly according to a fourth preferred embodiment of the present invention.
Figure 13:
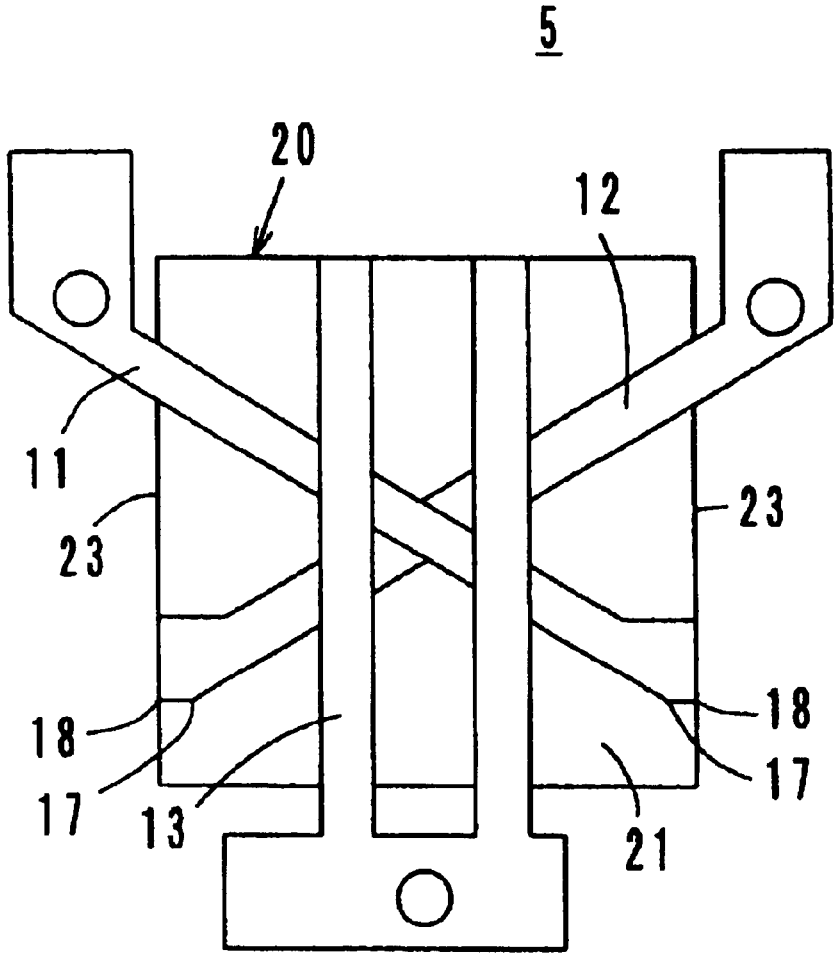
FIG. 13 is a plan view showing a center electrode assembly according to a fifth preferred embodiment of the present invention.
Figure 14:
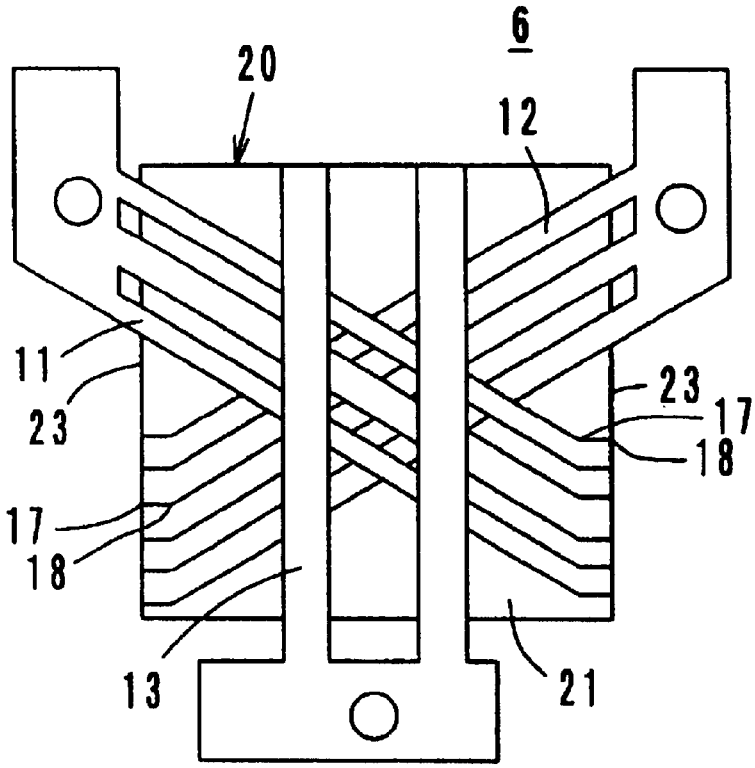
FIG. 14 is a plan view showing a center electrode assembly according to a sixth preferred embodiment of the present invention.
Figure 18:
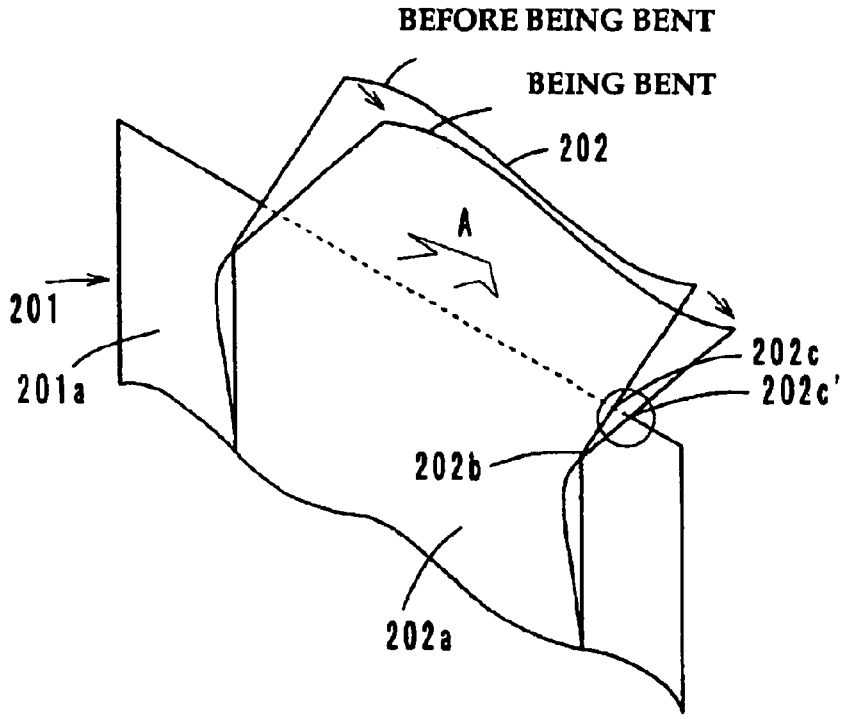
FIG.18 PRIOR ART
FIG. 18 is a perspective view showing a manner in which a central conductor is bent in the center electrode assembly of the known art.

As described above, the angular points 17, at which the crossing angle is determined, are positioned on the top surface 21 of the ferrite member 20. Thus, as shown in FIG. 8, each of the grounded leg portions 16 is bent at the upper ridge portion 23 in such a manner that the grounded leg portion 16 is substantially perpendicular to the upper ridge portion 23. Accordingly, the bending point 18 can be prevented from being displaced in the horizontal direction as in the known art (see FIG. 18) and the central conductors reliably cross each other at a designed crossing angle.

In the center electrode assembly 1 according to the first preferred embodiment, the central conductors 11, 12, and 13 are disposed accurately so that they cross each other at the desired crossing angle. Accordingly, electrical characteristics such as insertion loss characteristics and isolation characteristics can be made stable and closer to desired characteristics and input impedance characteristics can be made more uniform.

Furthermore, since each of the central conductors 11, 12, and 13 is divided into two branch conductors, the direction toward which each central conductor is bent is determined by the two branch conductors. Accordingly, the central conductors 11, 12, and 13 can be more reliably positioned with the desired crossing angle and the electrical characteristics can be further improved. Especially, the coupling factor can be greatly increased and loss can be significantly reduced over a wide band. In addition, since the two branch conductors have substantially the same width, they are bent in a similar manner at approximately the same curvature. Accordingly, the central conductors can be more reliably disposed at the desired crossing angle.

In addition, in the bending process of the central conductors, a process of guiding each central conductor toward the direction corresponding to the crossing angle while they are being bent can be omitted. The central conductors can be formed to have the desired crossing angle by merely pushing and bending, in a certain direction, each central conductor extending upward. Accordingly, the bending process can be easily performed and the mechanism of a processing machine made simpler, so that the manufacturing cost can be reduced.

In a center electrode assembly 2 according to a second preferred embodiment, each of the central conductors 11 and 12 has a single grounded leg portion 16, and is divided at a position closer to the distal end of the central conductor than the angular point 17. Other constructions and a method for bending the central conductors are similar to those in the first preferred embodiment.

In the second preferred embodiment, the width of the grounded leg portion 16 is increased and the bending point 18 is positioned at the wide portion. Accordingly, the strength of the bending point 18 is increased and the angle at which each central conductor is bent does not easily change after the bending process. More specifically, each of the central conductors can be reliably bent at a predetermined angle and the angle at which the central conductor is bent does not easily change afterwards, so that the characteristics can be made more stable. Other effects obtained in the second preferred embodiment are the same as those obtained in the first preferred embodiment.

A center electrode assembly 3 of a third preferred embodiment includes the ferrite member 20 having an oblong substantially rectangular shape which extends horizontally in a plan view, and a center electrode assembly 4 of a fourth preferred embodiment includes the ferrite member 20 having a substantially square shape in a plan view. In the first and the second preferred embodiments, the ferrite member 20 has an oblong substantially rectangular shape which extends vertically in a plan view.

Although disc-shaped ferrites are often used in center electrode assemblies, the size of the center electrode assemblies can be reduced by using ferrite members having a substantially rectangular shape.

In the third and fourth preferred embodiments, other constructions and a method for bending the central conductors are similar to those in the first preferred embodiment.

In a center electrode assembly 5 according to a fifth preferred embodiment, the central conductors 11 and 12 are not divided into two branch conductors and only the central conductor 13 is divided into two branch conductors similarly to the above-described first to fourth preferred embodiments.

In a center electrode assembly 6 according to a sixth preferred embodiment, each of the central conductors 11 and 12 is divided into three branch conductors and only the central conductor 13 is divided into two branch conductors similarly to the above-described first to fourth preferred embodiments.

In the fifth and sixth preferred embodiments, other constructions and a method for bending the central conductors are similar to those in the first preferred embodiment.

Generally, the allowance in a polishing process for a ceramic plate such as polycrystalline ferrite is approximately 0.03 mm in both the thickness and width directions. Thus, the allowance at each side in the width direction is about 0.015 mm. Because of the differences in size between each ferrite caused in polishing process, as well as differences between the jigs used for bending the central conductors and adjustment errors, there is a risk in that the angular points of the central conductors will be displaced and positioned on the side surfaces of the ferrite member. In such a case, the same problems as in the known art will occur.

Accordingly, the angular points 17 of the central conductors are preferably formed at points that are distant from the upper ridge portions 23 of the ferrite member 20 for at least about 0.03 mm. When the distance from the upper ridge portions 23 to the angular points 17 exceeds about 0.50 mm, the rate of the area in which the central conductors cross each other to the area of the ferrite member 20, which has dimensions of approximately 2 mm square, is reduced. Accordingly, portions of the central conductors which do not facilitate formation of the desired crossing angle are increased and undesirable coupling between these parts and high-frequency magnetic flux occurs. As a result, the isolation characteristics are degraded and operating bandwidth is reduced. Furthermore, desired coupling between the central conductors and high-frequency magnetic flux becomes insufficient, so that insertion loss characteristics are degraded and the operating bandwidth is further reduced.

For the above-described reasons, the length of parts of the central conductors which extend substantially perpendicularly to the ridge portions 23 from the upper ridge portions 23 to the angular points 17 is preferably set in the range of about 0.03 to about 0.50 mm. Accordingly, characteristics of the nonreciprocal circuit device can be made stable and degradations of the characteristics can be prevented.

Although the size of the nonreciprocal circuit device is preferably made as small as possible, when the size of the ferrite member is reduced, the ratio of the distance from the upper ridge portions to the angular points to the overall size of the central conductors is increased. In the center electrode assembly according to preferred embodiments of the present invention, the shape of the central conductors is greatly limited when the size of the ferrite is reduced to approximately 1 mm square or less.

When a ferrite member having a substantially rectangular shape having a length of the longer side that exceeds about 7 mm is included in a nonreciprocal circuit device that has a size that is larger than about 10 mm square, electrical characteristics and the size thereof do not differ from the case in which a disk-shaped ferrite member is used. Accordingly, the size of the ferrite member 20 is preferably determined such that the length of the side having the upper ridge portions 23 at which the grounded leg portions 16 of the central conductors are bent is in the range of about 1.0 mm to about 5.0 mm, the length of other sides is in the range of about 1.0 mm to about 7.0 mm, and the thickness of the ferrite member is in the range of about 0.2 mm to about 2.0 mm. When the size of the ferrite member 20 is determined as described above, a small, wide-band nonreciprocal circuit device having the desired characteristics can be obtained.

When the thickness of the central conductors is less than about 10 $\mu$m, the central conductors can be bent easily. Therefore, it may not be necessary to apply the present invention. However, central conductors having a thickness that is less than about 10 $\mu$m are not suitable for use in nonreciprocal circuit devices since large losses occur.

When the thickness of the central conductors exceeds about 120 $\mu$m, they cannot be bent reliably even when the present invention is applied. In addition, when the central conductors having such a large thickness are used, the distances between each of the three central conductors (ports) and the ferrite member differ by a large amount. Accordingly, the three ports are unbalanced, so that symmetrical characteristics cannot be obtained. Such a situation occurs especially when a small ferrite member having a substantially rectangular shape with a length of the longer side is about 7 mm or less is used.

For the above-described reasons, the thickness of the central conductors is preferably in the range of about 10 $\mu$m to about 120 $\mu$m. When the thickness of the central conductors is in this range, a small, low-loss, nonreciprocal circuit device having stable, symmetrical characteristics can be obtained.

With respect to the material for forming the central conductors, silver or copper is preferably used since the conductivity of the central conductors can be increased and the size and losses can be more effectively reduced.

In addition, when the central conductors are formed of brass, phosphor bronze, or beryllium copper, hardness of the central conductors can be increased, and the central conductors can be easily handled even when the thickness thereof is about 50 $\mu$m or less. In addition, compared with a ductile material such as copper, burr can be reduced in the press-forming process. Although conductivity is reduced compared with copper and silver, losses can be made as small as in the case in which the central conductors are formed of copper or silver by plating silver, or by using a silver clad material in which silver is bonded together with one of the above materials. Although there is a problem in that the central conductors are hard to bend, this problem can be solved by applying preferred embodiments of the present invention.

Figure 15:
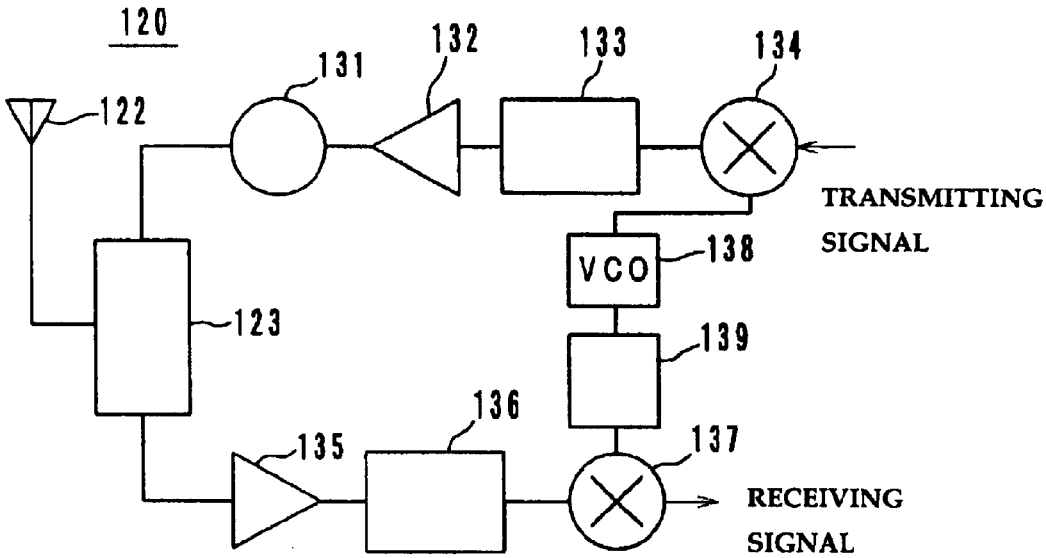
FIG. 15 is a block diagram showing the electrical circuit of a communication apparatus (mobile phone) according to another preferred embodiment of the present invention.
Figure 16A:
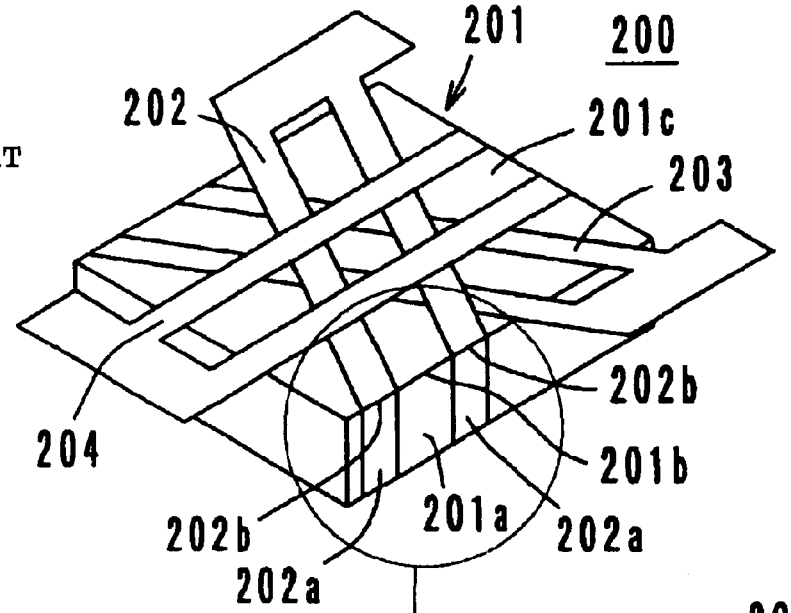
FIG.16A PRIOR ART
FIG. 16A is a perspective view showing a center electrode assembly of the known art.
Figure 16B:
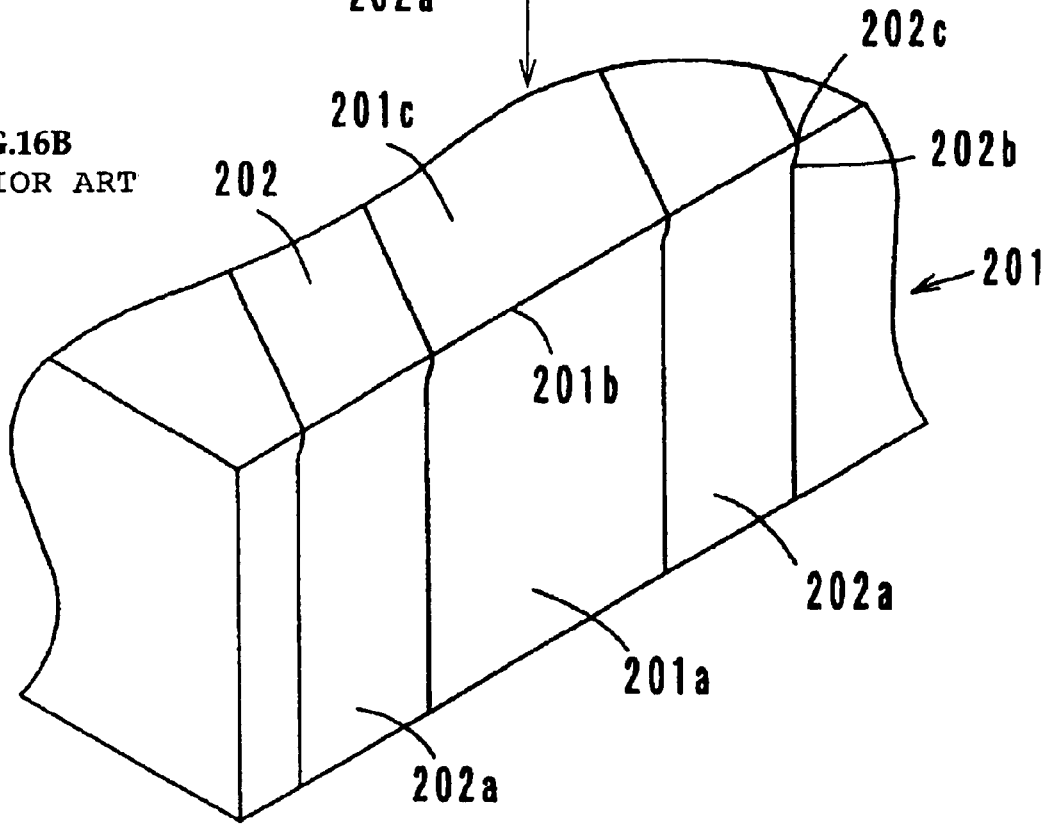
FIG.16B PRIOR ART
FIG. 16B is an enlarged view of a circled portion in FIG. 16A.
Figure 17:
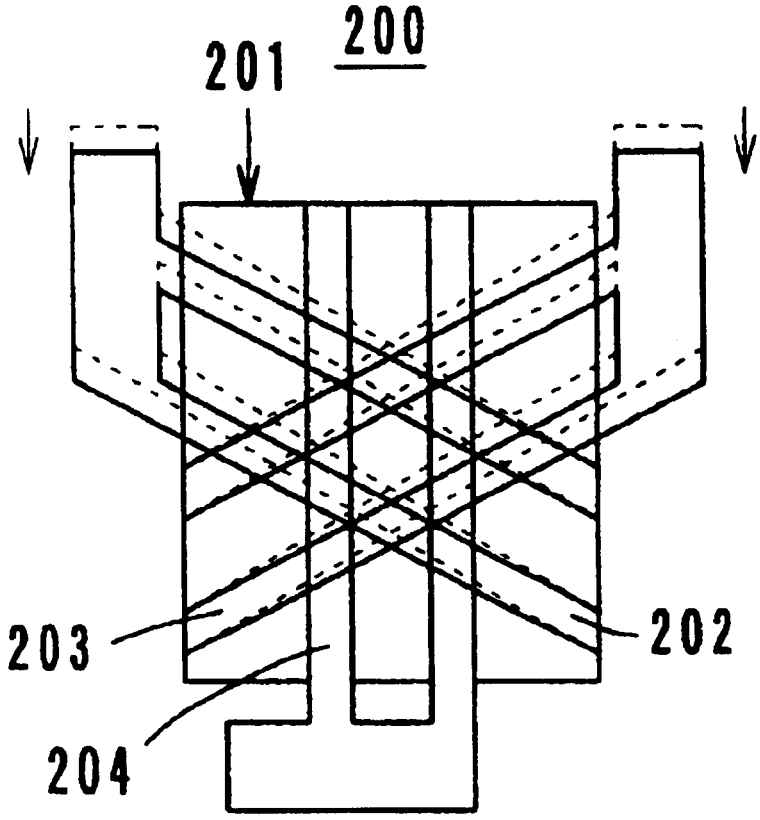
FIG.17 PRIOR ART
FIG. 17 is a plan view showing the center electrode assembly of the known art.

Next, a mobile phone will be described below as an example of a communication apparatus according to another preferred embodiment of the present invention. FIG. 15 is a diagram showing an electrical circuit 120 of an RF portion of a mobile phone. With reference to FIG. 15, the electrical circuit 120 includes an antenna element 122, a duplexer 123, a transmission isolator 131, a transmission amplifier 132, a transmission inter-stage bandpass filter 133, a transmission mixer 134, a reception amplifier 135, a reception inter-state bandpass filter 136, a reception mixer 137, a voltage controlled oscillator (VCO) 138, and a local bandpass filter 139.

The transmission isolator 131 may include a nonreciprocal circuit device (lumped-constant isolator) including one of the center electrode assemblies 1 to 6 according to the first to sixth preferred embodiments of the present invention. By installing a nonreciprocal circuit device including one of the center electrode assemblies 1 to 6, a mobile phone having stable electrical characteristics can be obtained.

The center electrode assembly, the manufacturing method thereof, the nonreciprocal circuit device, and the communication apparatus according to the present invention are not limited by the above-described preferred embodiments, and various modifications can be made within the scope of the present invention.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A center electrode assembly comprising:

a ferrite member having a top surface, a bottom surface and side surfaces connecting the top surface and the bottom surface;

a ground plate provided at the bottom surface of the ferrite member; and a plurality of central conductors;

wherein each of the central conductors includes a grounded leg portion which extends upward from the ground plate and along one of the side surfaces of the ferrite member, and which grounded leg portion is bent at an upper ridge portion of the ferrite member and extends on the top surface of the ferrite member, and wherein the grounded leg portion of each of the central conductors is bent in a such manner that the grounded leg portion is substantially perpendicular to the upper ridge portion of the ferrite member, and angular points of the central conductors, the angular points determining the crossing angle of the central conductors, are positioned on the top surface of the ferrite member.

2. A center electrode assembly according to claim 1, wherein at least one of the central conductors is divided into at least two branch conductors.

3. A center electrode assembly according to claim 2, wherein the at least two branch conductors have substantially the same width.

4. A center electrode assembly according to claim 2, wherein the at least two branch conductors are separated at a position closer to the distal end than the angular point.

5. A center electrode assembly according to claim 1, wherein each of the central conductors is divided into at least two branch conductors.

6. A center electrode assembly according to claim 5, wherein each of the branch conductors have substantially the same width.

7. A center electrode assembly according to claim 5, wherein each of the branch conductors is separated at a position closer to the distal end than the angular point.

8. A center electrode assembly according to claim 1, wherein the angular points of the central conductors are positioned within the range of about 0.03 mm to about 0.50 mm from the upper ridge portions of the ferrite member.

9. A center electrode assembly according to claim 1, wherein the size of the ferrite member is determined such that the length of the sides having the upper ridge portions at which the central conductors are bent is in the range of about 1.0 mm to about 5.0 mm, the length of other sides is in the range of about 1.0 mm to about 7.0 mm, and the thickness is in the range of about 0.2 mm to about 2.0 mm.

10. A center electrode assembly according to claim 1, wherein the thickness of the central conductors Is In the range of about 10 $\mu$m to about 120 $\mu$m.

11. A center electrode assembly according to claim 1, wherein each of the central conductors is made of one of silver and copper.

12. A center electrode assembly according to claim 1, wherein the central conductors are made of plated silver on a base material including one of brass, phosphor bronze, and beryllium copper.

13. A center electrode assembly according to claim 1, wherein the central conductors are made of a silver clad material in which sliver is bonded together with one of brass, phosphor bronze, and beryllium copper.

14. A center electrode assembly according to claim 1, wherein the ferrite member has a substantially rectangular shape.

15. A nonreciprocal circuit device comprising a center electrode assembly according to claim 1.

16. A communication apparatus comprising a nonreciprocal circuit device according to claim 15.

* * * * *